US005445381A

United States Patent [19]

Van Ert

[11] Patent Number: 5,445,381

[45] Date of Patent: Aug. 29, 1995

[54] ALL SEASON PUTTING SYSTEM

[76] Inventor: Floyd Van Ert, 1401 SW. 7th St., Atlantic, Iowa 50022

[21] Appl. No.: 345,993

[22] Filed: Nov. 29, 1994

[51] Int. Cl.[6] ..... A63B 67/02

[52] U.S. Cl. ..... 273/176 H; 273/178 B; 273/195 B; 273/DIG. 31

[58] Field of Search ..... 273/176 H, 178 B, 176 FB, 273/176 R, 176 G, 176 F, 176 J, 178 R, 195 R, 195 B, DIG. 31

[56] References Cited

U.S. PATENT DOCUMENTS

| | | | |
|---|---|---|---|
| 1,612,291 | 12/1926 | Jackson | 273/178 B |
| 2,539,046 | 1/1951 | Wright | 273/178 B |
| 2,678,823 | 5/1954 | Hugman | 273/176 H |
| 3,831,949 | 8/1974 | Henning | 273/176 H |
| 4,978,127 | 12/1990 | Juel, Jr. | 273/176 H |
| 5,002,280 | 3/1991 | Hines | 273/178 B |
| 5,123,651 | 6/1992 | Vinciguerra | 273/176 H |

*Primary Examiner*—V. Millin
*Assistant Examiner*—Steven B. Wong
*Attorney, Agent, or Firm*—Hovey, Williams, Timmons & Collins

[57] ABSTRACT

A practice putting green includes an elongated plank having a top wall and a plurality of depending, longitudinally extending ribs that stiffen the top wall against sagging along the length of the plank while allowing the top wall to twist under the weight of the plank. A putting surface is supported on the top wall, and a hole sized for receipt of golf balls extends through both the putting surface and the top wall. Legs are provided for independently adjusting the height of the putting surface at each corner, and the top wall twists under the weight of the plank to assume the shape dictated by the position of the legs. A system incorporating the putting green includes an elongated base positionable beside the green, a ball holding tray, and a catch tray positionable beneath the hole.

18 Claims, 2 Drawing Sheets

ALL SEASON PUTTING SYSTEM

BACKGROUND OF THE INVENTION

1. Field of the Invention

The present invention relates generally to golf equipment and, more particularly, to an all season putting system which permits a golfer to practice putting while indoors.

2. Discussion of the Prior Art

All season golf putting practice systems are available for permitting golfers to practice their putting strokes indoors so that they are not restricted to practicing the game only in good weather. Such systems range from a relatively simple roll-up carpet having a foam backing and a cup formed at one end thereof, to an entire indoor putting range having several different stationary playing holes, each presenting unique challenges to the golfer.

For individual golfers interested in setting up a practice system in their home or office, a simple system such as the roll-up carpet device is preferred since it permits easy transportation, set-up and storage of the device, and does not consume a significant amount of space. However, because roll-up devices lay directly on the ground during use, the cup formed in the carpet is very shallow, and is only able to accommodate one or two golf balls before it is necessary for the golfer to walk to the cup and retrieve the balls. Thus, practice must be interrupted frequently.

Alternate constructions exist which include a putting surface that is raised off of the ground by a distance sufficient to permit the use of a sloped ball return path leading away from beneath the cup back toward the golfer. By providing this feature, it is not necessary for the golfer to ever interrupt practice as the balls automatically are returned by the device.

Known raised systems include a rigid frame that spans the entire length and width of the putting device, and are much heavier than simpler designs. Thus, conventional raised constructions provide certain advantages over roll-up devices, but at the cost of added weight and complexity. In addition, because the putting surface of such systems is raised off of the ground, it is necessary to provide a separate standing base adjacent the surface that must be moved along the length of the surface each time the golfer chooses to change the length of the putts being practiced.

Another feature of conventional raised putting systems is that they may be leveled above the floor on which they are set up so as to provide a truly horizontal putting surface. This represents an improvement over roll-up systems that rest directly on the floor. However, many golfers would like to practice putting across a breaking surface which more closely simulates a real outdoor putting green. Available raised putting systems permit the entire frame to be angled to accomplish such adjustment in the break of the putting surface, but do not permit one end of the putting surface to be twisted relative to the other in order to simulate a more complex break across the surface.

OBJECTS AND SUMMARY OF THE INVENTION

It is an object of the present invention to provide a raised putting system that permits one end of a putting surface to be twisted relative to the other end in order to permit practice of either level or complex breaking putts. In addition, the system is lightweight, and of a simple design, permitting easy, inexpensive transportation, set-up and storage of the system.

Another object of the invention is to provide a putting system that permits a golfer to putt several balls before having to retrieve them, without complicating the construction of the system or requiring the use of a rigid frame having a heavy ball return system. By providing a collection tray beneath the cup formed in the putting green and a holding tray mounted adjacent the other end of the green, it is possible to putt several balls from any position on the putting green, and then to retrieve the balls and store them in the holding tray until they are needed again.

It is another object of the invention to provide a raised putting system having an elongated base that is positioned beside the putting surface to support a golfer at any desired putting position, wherein it is not necessary to reposition the base each time the desired position changes.

In accordance with these and other objects evident from the following description of a preferred embodiment of the invention, a putting green is provided for use in putting golf balls. The green includes an elongated plank having a top wall and a plurality of depending, longitudinally extending ribs, and a putting surface supported on the top wall and presenting four corners. A hole extends through both the putting surface and the top wall.

Leg means are provided on the green for independently adjusting the height of the putting surface at each corner, and the ribs stiffen the top wall against sagging along the length of the plank while allowing the top wall to twist under the weight of the plank to accommodate adjustment of the leg means. Thus, the break of the putting green can be adjusted relative to the underlying floor, and easily and repeatedly changed to suit the whims of the golfer.

In preferred forms of the invention, a base is provided which includes an upper surface generally level with the putting surface for supporting a golfer during practice. The base is at least half as long as the putting green so that it is not necessary to reposition the base when practicing putts of different lengths. Instead, the golfdr simply walks along the base to the desired distance from the cup and begins practicing.

In addition, the putting system of the present invention also includes a catch tray positionable beneath the hole for catching balls that drop through the hole. The catch tray is sized to retain several balls so that it is only necessary to retrieve them occasionally, and adds very little complexity or weight to the construction.

The putting green and base of the system are preferably constructed of extruded aluminum planks of a type conventionally used in the construction of stadium benches and the like, and therefore require only readily available materials. This feature of the invention simplifies construction of the system and results in a lightweight design that accomplishes the objects presented above.

BRIEF DESCRIPTION OF THE DRAWING FIGURES

The preferred embodiment of the present invention is described in detail below with reference to the attached drawing figures, wherein.

DETAILED DESCRIPTION OF THE PREFERRED EMBODIMENT

Figures 1, 2, 3, 4:
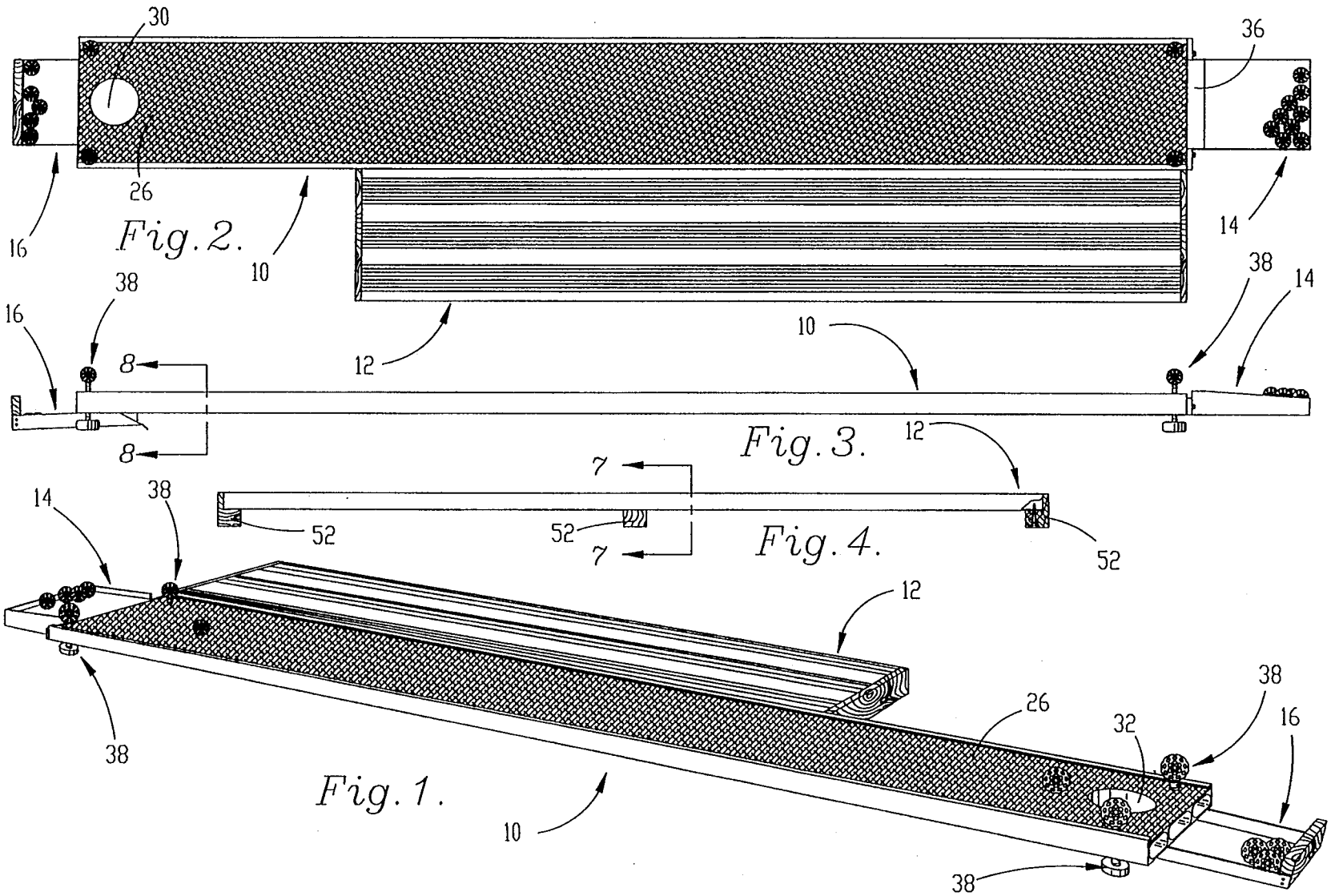
FIG. 1 is a perspective view of a putting system constructed in accordance with the preferred embodiment.
FIG. 2 is a top plan view of the system.
FIG. 3 is a side elevational view of a putting green forming a part of the system.
FIG. 4 is a side elevational view of a standing base forming a part of the system.

A putting system constructed in accordance with the preferred embodiment of the present invention is shown in FIG. 1, and broadly includes a putting green 10, a standing base 12, a holding tray 14, and a collection tray 16.

Figures 5, 6, 7, 8, 9, 10, 11:
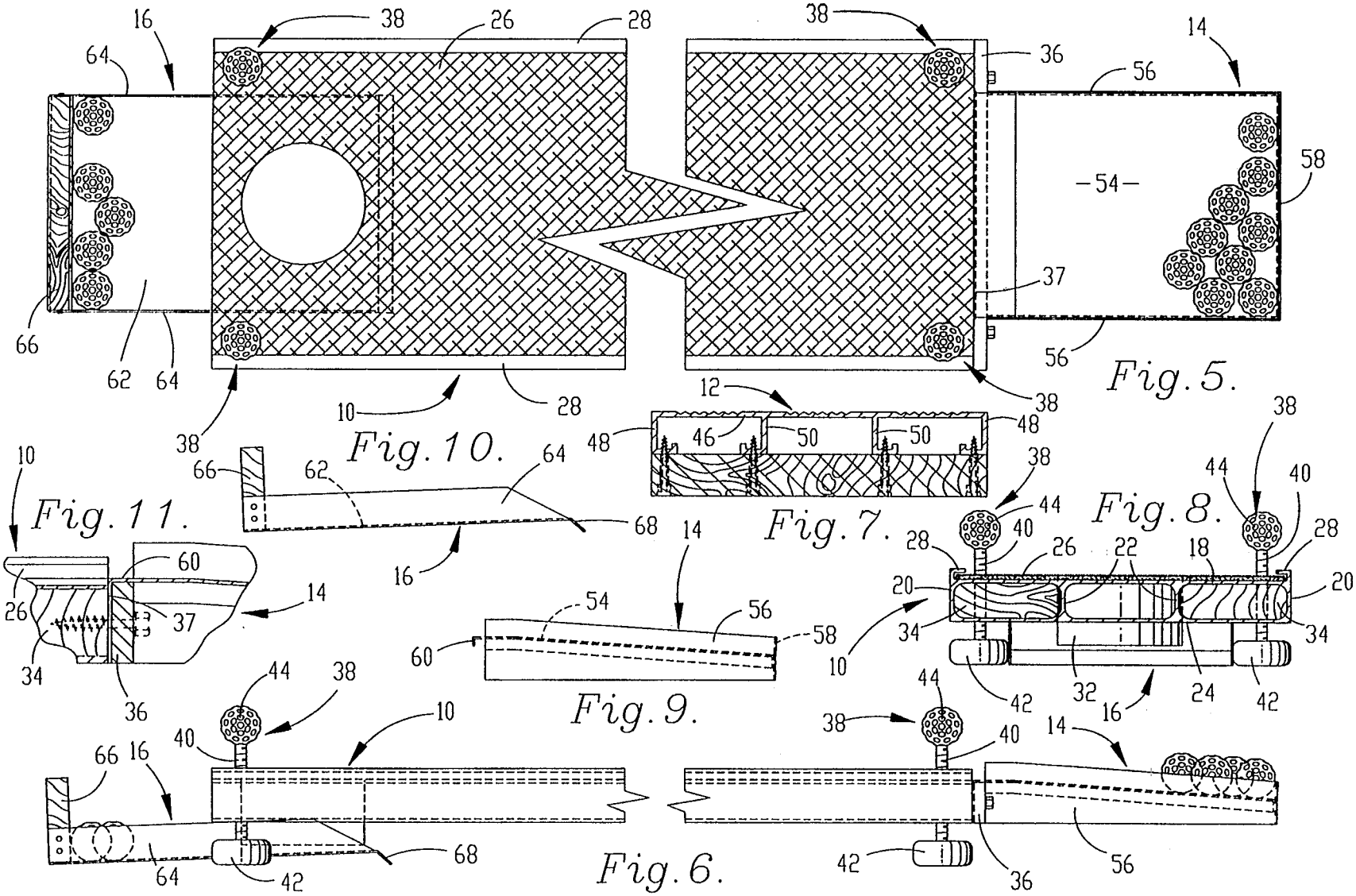
FIG. 5 is a fragmentary top plan view of the putting green.
FIG. 6 is a fragmentary side elevational view of the putting green.
FIG. 7 is a sectional view of the base taken along line 7—7 of FIG. 4.
FIG. 8 is a sectional view of the putting green taken along line 8—8 of FIG. 3.
FIG. 9 is a side elevational view of a ball holding tray forming a part of the system.
FIG. 10 is a side elevational view of a ball catch tray forming a part of the system.
FIG. 11 is a fragmentary sectional view illustrating the mounting arrangement between the putting green and the ball holding tray.

The putting green 10 is formed of an elongated, extruded aluminum plank of the type typically used in the construction of stadium benches and the like, as shown in FIG. 8, the plank including a top wall 18 and a plurality of depending, longitudinally extending ribs 20, 22. Two of the ribs 20 extend along the lateral edges of the top wall and define side walls of the plank, and the remaining ribs 22 are interior of the side walls, and add longitudinal rigidity to the top wall so that it does not sag between the ends.

Although the ribs 20, 22 support the top wall 18 along the longitudinal axis of the plank, they permit the top wall to twist about the axis under the weight of the plank. Thus, the plank is torsionally flexible, permitting the ends of the plank to be twisted relative to one another.

The plank may also include a bottom wall 24 that is spaced from the top wall and connected to the ribs. The bottom wall provides additional support to the upper wall against sagging, but at the cost of adding weight to the green and of reducing the torsional flexibility of the top wall.

A putting surface 26 is supported on the top wall of the plank, and is preferably held in place by an adhesive or other suitable fastening means. If desired, the plank may be formed with an L-shaped lip 28 along each edge under which the carpet is received. The lips 28 serve the double function of holding the carpet in place and presenting a small ridge for keeping balls on the green.

As shown in FIG. 2, a hole 30 extends through both the putting surface and the top wall at a position adjacent one end of the green 10, and is sized in accordance with the requirements set forth for cups in the rules of golf. Preferably, a cylindrical cup 32 is mounted within the hole, as shown in FIG. 8, and includes a cylindrical side wall that guides balls through the hole into the collection tray 16. The bottom of the cup is left open.

The green also includes holes passing through both the plank and putting surface at the four corners of the green. Wood blocks 34 are supported on the plank beneath each of these holes, and are tapped to present threaded holes coaxial with the holes in the plank. Alternately, nuts could be welded to the underside of the top wall in alignment with each of the holes to present the threaded holes.

At the end of the plank opposite the cup, a mounting bar 36 is secured which is adapted to support the holding tray 14. The mounting bar is illustrated in FIG. 5, and includes an elongated slot 37 within which the tray is secured. As shown in FIG. 11, suitable fasteners are used to hold the mounting bar in place on the plank.

Returning to FIG. 1, the green 10 also includes leg means for independently adjusting the height of the putting surface at each corner. The leg means are defined by separate legs 38 received in each of the threaded holes. Further, as shown in FIG. 8, each leg includes a threaded member 40 that is received in one of the threaded holes of the plank and presents upper and lower ends, a foot 42 attached to the lower end of the member and a knob 44 fastened to the upper end of the member. The feet 42 are formed of wood or other suitable material, and the knobs 44 are preferably formed of golf balls which are easily gripped and also attractive.

During set-up of the green, the legs 38 are threaded up or down relative to the putting surface to adjust the height of each corner of the putting surface above the feet. If a true horizontal surface is desired, a level is placed on the putting surface, and the legs are raised or lowered until each end of the green is true. Alternately, if a slight break is desired, one of the legs at the end of the green adjacent the cup is lowered or raised relative to the others, and the top wall twists under the weight of the plank to maintain contact between all of the feet and the floor.

If an even greater degree of break is desired, both legs along one side of the green can be adjusted so that the top wall slants sideways along the entire length of the putting surface rather than just at the second end adjacent the cup. Likewise, it is possible to adjust the incline of the putting surface by adjusting the two legs at each end of the plank relative to the legs at the other end.

The base 12 is illustrated in FIG. 4, and includes an elongated, extruded aluminum plank similar to the plank used in the putting green and feet 52 for supporting the plank. The base plank is shown in FIG. 7 and presents a top wall 46 on which a golfer stands when using the system, and a plurality of ribs 48, 50 for stiffening the top wall to prevent it from sagging. The transverse feet 52 are fastened to the base at spaced locations along the length of the plank, and position the top wall flush with the putting surface 26 of the green.

Preferably, as shown in FIG. 2, the base is long enough to extend from the end of the green remote from the cup to a position within one to three feet from the cup so that a golfer is able to stand on a level with the putting surface when using the system, and can walk back and forth along the base to any desired putting position without having to reposition the base.

The holding tray 14 is shown in FIG. 9, and includes a sloped bottom wall 54 bounded by opposed side walls 56 and a rear wall 58. The bottom wall includes an L-shaped lip 60 protruding beyond the side walls and sized for receipt in the slot 37 of the mounting bar 36 so that the tray may be suspended from the end of the putting green. The side and rear walls 56, 58 retain balls in the tray, and the slope of the bottom wall is away from the putting surface so that balls gravitate toward the rear wall. The front edge of the bottom wall is level with the putting surface so that when a golfer wants a ball, they simply roll the ball from the tray with their putter and position it for putting.

The collection tray 16 is shown in FIG. 10, and includes a bottom wall 62 bounded by side walls 64 and a rear wall 66. The bottom and side walls 62, 64 are preferably formed of sheet metal, and the bottom wall includes a forward lip 68 that is turned down to support the tray at an angle. By providing this construction, the bottom wall is maintained in a sloped orientation that causes balls in the tray to gravitate toward the rear wall.

As shown in FIG. 6, the rear wall 66 is taller than the side walls 64 and serves as a handle by which the tray can be gripped. In addition, the rear wall abuts against the end of the putting green when the tray is pushed beneath the cup, and positions the tray so that balls falling through the cup are caught and retained in the tray.

During use, as shown in FIG. 3, once the tray 16 has been filled with balls, it is removed from beneath the cup, and the balls in the tray are transferred to the holding tray 14. Thereafter, the balls are available for putting, and the collection tray is repositioned beneath the cup.

Although the present invention has been described with reference to the preferred embodiment illustrated in the attached drawing figures, it is noted that substitutions may be made and equivalents employed herein without departing from the scope of the invention as recited in the claims.

What is claimed is:

1. A putting green for use in putting golf balls, comprising:

an elongated plank having a top wall and a plurality of depending, longitudinally extending ribs;

a putting surface supported on the top wall and presenting four corners;

a hole extending through both the putting surface and the top wall and being sized for receipt of the golf balls; and leg means for independently adjusting the height of the putting surface at each corner, wherein the ribs stiffen the top wall against sagging along the length of the plank while allowing the top wall to twist under the weight of the plank to accommodate adjustment of the leg means.

2. A putting green as recited in claim 1, wherein the plank is formed of an extruded piece of aluminum.

3. A putting green as recited in claim 1, wherein the putting surface is defined by a carpet that is supported on the top wall of the plank.

4. A putting green as recited in claim 1, further comprising a cup supported within the hole, the cup having a cylindrical side wall having a diameter about the same as the hole, and an open bottom end for directing balls through the cup.

5. A putting green as recited in claim 1, wherein the plank includes a threaded hole at each corner of the putting surface, and the leg means includes separate legs received in each of the threaded holes.

6. A putting green as recited in claim 5, wherein each leg includes a threaded member that is received in one of the threaded holes of the plank and presents upper and lower ends, a foot attached to the lower end of the member and a knob fastened to the upper end of the member.

7. An all season putting system for use in putting golf balls, comprising:

a generally rectangular putting green formed of an elongated plank having a top wall and a plurality of depending, longitudinally extending ribs, a putting surface supported on the top wall and presenting four corners, and a hole extending through both the putting surface and the top wall and being sized for receipt of the golf balls;

a base positionable beside the putting green and including an upper surface that is generally level with the putting surface;

a catch tray positionable beneath the hole for catching balls that drop through the hole; and leg means for independently adjusting the height of the putting surface at each corner, wherein the ribs stiffen the top wall against sagging along the length of the plank while allowing the top wall to twist under the weight of the plank to accommodate adjustment of the leg means.

8. A putting system as recited in claim 7, wherein the plank is formed of an extruded piece of aluminum.

9. A putting system as recited in claim 7, wherein the putting surface is defined by a carpet that is supported on the top wall of the plank.

10. A putting system as recited in claim 7, further comprising a cup supported within the hole, the cup having a cylindrical side wall having a diameter about the same as the hole, and an open bottom end for directing balls through the cup.

11. A putting system as recited in claim 7, wherein the plank includes a threaded hole at each corner of the putting surface, and the leg means includes separate legs received in each of the threaded holes.

12. A putting system as recited in claim 11, wherein each leg includes a threaded member that is received in one of the threaded holes of the plank and presents upper and lower ends, a foot attached to the lower end of the member and a knob fastened to the upper end of the member.

13. An all season putting system as recited in claim 7, wherein the base includes an elongated plank that is at least half as long as the putting green.

14. An all season putting system as recited in claim 7, wherein the base is formed of an extruded piece of aluminum.

15. An all season putting system as recited in claim 7, wherein the catch tray includes an angled bottom wall, a plurality of side walls, and a rear wall, the bottom and side walls being sized for receipt beneath the putting green plank.

16. An all season putting system as recited in claim 15, wherein the rear wall of the catch tray extends upward from the tray and abuts against the putting green plank when the tray is positioned with the bottom wall beneath the hole in the putting green.

17. An all season putting system as recited in claim 7, further comprising a holding tray positionable beside the putting green for holding balls, the holding tray including an angled bottom wall and a means for supporting the tray on the putting green with the bottom wall aligned with the putting surface.

18. An all season putting system as recited in claim 17, wherein the bottom wall of the holding tray slopes away from the putting surface.

* * * * *